US009489930B1

(12) United States Patent
Linquist

(10) Patent No.: US 9,489,930 B1
(45) Date of Patent: Nov. 8, 2016

(54) WRIST ALIGNMENT DEVICE FOR STRINGED MUSICAL INSTRUMENTS

(71) Applicant: Michelle Darlene Linquist, Dallas, TX (US)

(72) Inventor: Michelle Darlene Linquist, Dallas, TX (US)

(73) Assignee: HARMONIOUS DESIGNS LLC, Plano, TX (US)

( * ) Notice: Subject to any disclaimer, the term of this patent is extended or adjusted under 35 U.S.C. 154(b) by 0 days.

(21) Appl. No.: 14/887,437

(22) Filed: Oct. 20, 2015

(51) Int. Cl.
*G10D 3/18* (2006.01)

(52) U.S. Cl.
CPC ..... *G10D 3/18* (2013.01)

(58) Field of Classification Search
CPC ..... G10D 3/18
See application file for complete search history.

(56) References Cited

U.S. PATENT DOCUMENTS 247,796 A * 10/1881 Brady ..... G10D 3/18 84/281
542,278 A * 7/1895 Petermann ..... G10D 3/18 84/281
776,434 A * 11/1904 Smith ..... G10D 3/18 84/281
896,721 A * 8/1908 Goldenberg ..... G10D 3/18 84/281
1,271,460 A * 7/1918 Handel ..... G10D 3/18 84/281
1,740,824 A * 12/1929 Von Linprun Inka ... G10D 3/00 84/281
1,764,162 A * 6/1930 Glucksman ..... G10D 3/00 84/281
1,824,901 A * 9/1931 Kessler ..... G10D 3/00 84/281
1,886,070 A * 11/1932 Weber ..... G10D 3/00 84/281
1,906,584 A * 5/1933 Hays ..... G10D 3/18 84/281
2,056,819 A * 10/1936 Bodee ..... G10D 3/18 84/281
2,240,696 A * 5/1941 Gusman ..... G09B 15/06 84/281
2,761,346 A * 9/1956 Kuchler ..... G10D 3/18 84/281
3,619,470 A * 11/1971 Harris ..... G10D 3/18 84/281
7,615,698 B2 * 11/2009 Woodhouse ..... G10D 3/00 84/281
7,897,857 B2 * 3/2011 Lockwood ..... G09B 15/06 84/267
8,829,317 B1 * 9/2014 Linquist ..... G10D 3/18 84/280
2008/0271585 A1 * 11/2008 Jones ..... G09B 15/06 84/281

* cited by examiner

*Primary Examiner* — Robert W Horn
(74) *Attorney, Agent, or Firm* — Vesna N. Rafaty

(57) ABSTRACT

A wrist alignment system for attachment to a stringed musical instrument comprising a neck and a nose, the system comprising a device comprising a three-dimensional smooth body comprising a substantially flat planar end, a substantially oblong end opposite the flat planar end, a top rounded edge, a substantially flat bottom edge and integral first and second attachment elements, the first attachment element attached to the flat planar end, the second attachment element attached to the substantially flat bottom edge, the first and second attachment elements being substantially arcical in shape and comprising two gripping ends adapted to removably attach the device to the neck and the nose of the instrument, respectively, wherein the device places a player's wrist in substantially vertical alignment with the corresponding forearm of the player and allows rotation of the wrist for placement of the player's fingers on the fingerboard.

5 Claims, 1 Drawing Sheet

WRIST ALIGNMENT DEVICE FOR STRINGED MUSICAL INSTRUMENTS

BACKGROUND OF THE INVENTION

The disclosed invention is directed generally to devices that help promote proper hand posture in use of a musical instrument and more specifically to devices directed to promoting an ergonomic (vertical) alignment of the wrist-to-hand posture of a player of a stringed instrument such as but not limited to a violin.

Maintaining the correct wrist posture is critical when playing an instrument such as the violin, viola or fiddle as it affects a player's ability to reach all of the strings on the fingerboard and the ability to perform more advanced playing techniques such as vibrato. The ideal position of a player's wrist is upright, meaning approximately in a vertical, linear alignment between the player's left hand and left forearm. Disclosed is a device that inhibits the player's ability to collapse his/her wrist against the neck of the instrument, a condition commonly referred to as "pizza hand" or "waiter hand." A player, especially a novice, is tempted to adopt a pizza hand posture for the wrist, to support the instrument's neck similar to the wrist-hand posture adopted by a waiter carrying a tray. However, a pizza hand is not desired for ergonomic reasons and for the reason that such a posture inhibits a player's ability to reach the strings of the instrument. The majority of a player's time is spent in independent practice and outside of the traditional lesson setting with an instructor present who can prompt the player to correct and adopt the preferred wristband posture. Time spent in independent practice creates a risk of learning the incorrect posture which then needs to be corrected or consistently re-taught in lessons.

U.S. Pat. No. 7,897,857 to Lockwood entitled "Self-Corrective Wrist Positioning Practice Device" is directed to a device that is placed on the hand and forearm of the player. The device employs negative reinforcement to promote proper wrist alignment by physically applying pressure to the player's forearm and hand area potentially causing discomfort and irritation. The known device which offers an invasive solution is not readily independently usable by very young players because of its manner of attachment and the use of the device may require the assistance of an adult instructor who will place, adjust the device properly.

U.S. Pat. No. 8,829,317 to Applicant entitled "Wrist Alignment Device for Stringed Musical Instruments" discloses embodiments for wrist alignment devices which are designed to be attached to the stringed instrument, and the U.S. Pat. No. 8,829,317 discloses attachment means for the devices, including attachment means comprising magnets. The Applicant discovered an improved attachment means disclosed herein that does not comprise magnets, does not utilize adhesives and is cheaper and easier to manufacture. The disclosed invention may be understood with the help of the disclosure below and including the attached drawings.

SUMMARY OF THE INVENTION

The present invention relates to training, promoting or correcting the wrist posture of players of instruments such as for example and not by way of limitation the violin, viola and fiddle. The disclosed device is designed for attachment to the instrument and not the player's hand as per known prior art. The disclosed wrist alignment device promotes approximately vertical alignment of the player's left wrist while allowing rotation of the wrist as needed for finger placement on the fingerboard of the instrument. It is noted that in this disclosure the term 'ball of the hand' refers to the fleshy, rounded portion of the hand that is located approximately between the base of the thumb and the wrist. Thus, in accordance with a preferred embodiment of the disclosed invention, described is a wrist alignment system for attachment to a stringed musical instrument comprising a the system comprising a device comprising a three-dimensional smooth body comprising a substantially flat planar end, a substantially oblong end opposite the flat planar end, a top rounded edge, a substantially flat bottom edge and integral first and second attachment elements, the first attachment element attached to the flat planar end, the second attachment element attached to the substantially flat bottom edge, the first and second attachment elements being substantially arcical in shape and comprising gripping ends adapted to removably attach the device to the neck and the nose of the instrument, respectively, wherein the device places a player's wrist in substantially vertical alignment with the corresponding forearm of the player and allows rotation of the wrist for placement of the player's fingers on the fingerboard. The first and second attachment elements are each preferably constructed of a strong yet lightweight material such as aluminum or steel wires which are coated in a vinyl material or similar material where the material is chosen so that it allows for a secure but gentle gripping of the surface of the nose and neck of the instrument, respectively. It will be obvious to one of ordinary skill in the relevant art that alternative materials of construction are possible for the first and second attachment elements.

The three-dimensional body is preferably constructed from extruded or expandable polystyrene foam (e.g., Styrofoam) or similar lightweight material and is sized and adapted to be smooth so that its substantially oblong-shaped surface comes in gentle and non-invasive contact with the ball of the player's hand. The oblong shape is the preferred shape for the intended purpose. The size of the three dimensional body is adapted for the size of the instrument and the size of the ball of the player's hand such that the oblong device allows the ball of the player's band to come into contact with the oblong, rounded portion of the body of the device while allowing the player's fingers to properly reach all of the strings.

The applicant has experimented with various methods of construction for the first and second attachment elements. Bendable but strong aluminum or steel wires were found to be suitable. Per a preferred embodiment, for illustration and not by way of limitation, for a larger size wrist alignment device adapted for larger instruments and larger player hands, the vinyl coated wires used for the neck and nose attachment elements are preferably ½ inch in width, 1.5625 to 2.4375 inches in length and 0.03125 inches in thickness. The wires are bent to form an arcical, semi-circular shape with resultant grips that gently, securely, and removably attach the device to the neck of the instrument (the flat planar end of the three-dimensional body with the integral neck attachment element facing the neck of the instrument and the substantially oblong-shaped surface of the three-dimensional body facing out away from the neck). Per an alternative embodiment for a smaller sized device for smaller instruments and smaller player hands, a smaller steel wire measuring 3/16 inch in width, 1.4375 in length and 0.03125 inches in thickness may preferably be used.

The disclosed device comprising integral neck and nose attachment elements is thus adapted to allow for quick (e.g. 'push in place) attachment and removal of the device from the instrument. The arcical-shaped vinyl-coated wire grips of the neck and nose attachment elements allow for the ready, on demand removal of the device from the instrument to allow for play without the aid of the wrist alignment device. It will be obvious to ones of ordinary skill in the relevant art that alternative designs for the attachment of the disclosed device to the instrument are possible and are deemed to be within the scope of this invention.

The device is attached to the neck of the instrument on the side of the neck that is opposite the fingerboard and generally near the nose of the instrument and over the nose of the instrument where the neck and nose meet. The curved grips of the neck attachment element portion of the device and the nose attachment element portion of the device are preferably each coated in a vinyl or similar material so to be smooth.

The oblong-shaped portion of the three-dimensional body of the disclosed device is sized and shaped to come into contact with the ball of the left band of the player thus serving as a non-invasive, consistent guide for holding the wrist in an upright position during instrument play and inhibiting "waiter hand." The size of the disclosed wrist alignment device, and the component parts used in the manner of attachment of the device to the instrument, is dependent upon the size of the instrument, the expected width of the player's left thumb pad, and the anticipated size or length of the ball of the left hand, where that is defined as the rounded area of the palm located between the base of the thumb and the wrist. This placement is based on the thumb being placed in what is recognized in the industry as $1^{st}$ position however, the multiple sizes of the device available accommodate the various teaching methods (Ie. thumb placement between $1^{st}$ and $2^{nd}$ position).

DETAILED DESCRIPTION OF THE DRAWINGS

Figure 1:
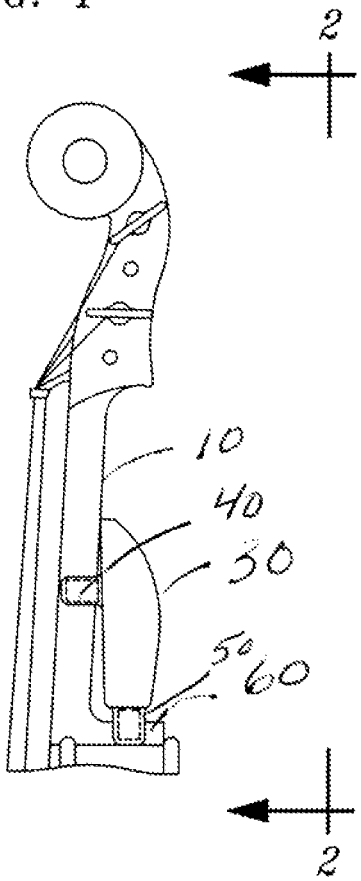
FIG. 1 is a side perspective showing the disclosed device attached to a stringed musical instrument (violin).

FIG. 1 is a side perspective showing the disclosed device 30 attached to a stringed musical instrument. Shown is the three-dimensional body 30 with a neck attachment element 40 gripping the neck 10 of the instrument and a nose attachment element 50 gripping the nose 60 of the instrument.

Figure 2:
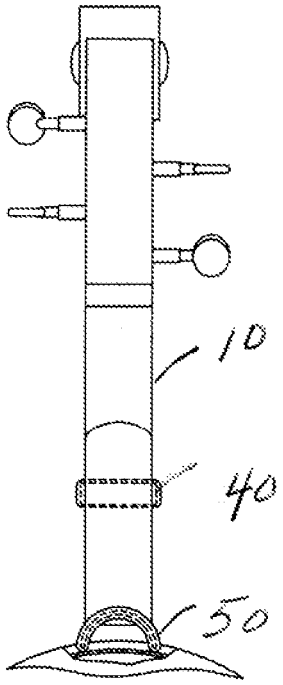
FIG. 2 is a top perspective of the back side of the stringed instrument with the disclosed device attached.

FIG. 2 is a top perspective of the back side of the stringed instrument with the disclosed device attached showing the neck attachment element 40 and the nose attachment element 50.

Figure 3:
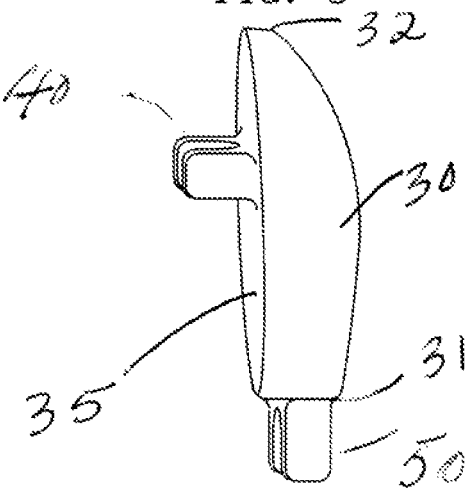
FIG. 3 is a side perspective of the disclosed device.

FIG. 3 is a side perspective of the disclosed device showing the three-dimensional body 30, the substantially flat planar end 35 of the body 30 that is opposite the substantially oblong-shaped side, the integral neck attachment element 40 attached to the flat planar end 35 and the integral nose attachment element 50 attached to the substantially flat bottom end 31 of the device which is opposite the top rounded edge 32 of the device.

Figure 4:
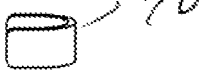
FIG. 4 is a side perspective of a first attachment element per the preferred embodiment of the disclosed device.

FIG. 4 is a side perspective of a first attachment element (neck attachment element) per the preferred embodiment of the disclosed device.

Figure 5:
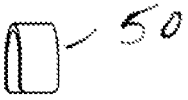
FIG. 5 is side perspective of a second attachment element per the preferred embodiment of the disclosed device.

FIG. 5 is side perspective of a second attachment (nose attachment element) element per the preferred embodiment of the disclosed device.

I claim:

1. A wrist alignment system for attachment to a stringed musical instrument comprising a neck and a nose, the system comprising a device comprising a three-dimensional smooth body comprising a substantially flat planar end, a substantially oblong end opposite the flat planar end, a top rounded edge, a substantially flat bottom edge and integral first and second attachment elements, the first attachment element attached to the flat planar end, the second attachment element attached to the substantially flat bottom edge, the first and second attachment elements being substantially arcical in shape and each comprising gripping ends adapted to removably attach the device to the neck and the nose of the instrument, respectively, wherein the device places a player's wrist in substantially vertical alignment with the corresponding forearm of the player and allows rotation of the wrist for placement of the player's fingers on the fingerboard.

2. The wrist alignment device per claim 1 wherein the musical instrument is a violin.

3. The wrist alignment device per claim 1 wherein the musical instrument is a viola.

4. The wrist alignment device per claim 1 wherein the musical instrument is a fiddle.

5. The wrist alignment device per claim 1 wherein the oblong body is constructed of Styrofoam or similar lightweight material.

* * * * *